United States Patent [19]

Orton

[11] Patent Number: 4,508,465

[45] Date of Patent: Apr. 2, 1985

[54] APPARATUS FOR CLEANING PAINT ROLLERS

[76] Inventor: J. Berkeley Orton, R.R. #1, Heyburn, Id. 83336

[21] Appl. No.: 461,961

[22] Filed: Jan. 28, 1983

[51] Int. Cl.[3] ..... A46B 17/06; B08B 3/02

[52] U.S. Cl. ..... 401/11; 401/36; 401/136; 401/137; 401/139; 401/261; 401/265; 401/266; 15/1

[58] Field of Search ..... 401/9, 11, 28, 36, 42, 401/43, 136, 139, 266, 137, 265, 261

[56] References Cited

U.S. PATENT DOCUMENTS

| | | | |
|---|---|---|---|
| 680,427 | 8/1901 | Carryl | 401/36 |
| 1,407,955 | 2/1922 | Smalley | 401/139 |
| 1,741,435 | 12/1929 | Rickersberg | 401/136 |
| 1,775,221 | 9/1930 | Bausback | 401/136 |
| 2,831,488 | 4/1958 | Anderson | 134/138 |
| 2,985,178 | 5/1961 | Christensen, Jr. . | |
| 3,075,534 | 1/1963 | Habostad | 134/138 |
| 3,587,599 | 6/1971 | Bywater | 134/138 |
| 3,608,120 | 9/1971 | Seiler . | |
| 3,731,697 | 5/1973 | Yost . | |
| 3,755,840 | 9/1973 | Barger . | |
| 3,897,797 | 8/1975 | Wright | 134/113 |

FOREIGN PATENT DOCUMENTS

| | | | |
|---|---|---|---|
| 181904 | 3/1907 | Fed. Rep. of Germany | 401/11 |
| 333900 | 2/1929 | France | 401/136 |
| 1060141 | 11/1953 | France | 401/136 |

*Primary Examiner*—Steven A. Bratlie

*Attorney, Agent, or Firm*—Workman, Nydegger & Jensen

[57] ABSTRACT

An apparatus attachable to the end of a garden hose for cleaning paint from paint rollers and the like. The apparatus includes a first nozzle having a generally arcuate shaped opening for delivering a gentle stream of water to soak the paint roller and to remove the bulk of the paint adhering thereto. The arcuate opening can also function as a scraper to help remove paint from the roller. A second high pressure nozzle is provided to direct a jet of water against the roller. The jet of water is designed to penetrate the fibers of the roller to loosen embedded paint and to impart a spinning motion to the roller, thus causing the paint and water to be spun off of the roller. One or move valves are provided in the apparatus to control the flow of fluid to the two nozzles.

14 Claims, 6 Drawing Figures

APPARATUS FOR CLEANING PAINT ROLLERS

BACKGROUND

1. Field of the Invention

The present invention relates to apparatus used to clean paint from paint rollers and, more particularly, to a unique hand held paint roller cleaner for attachment to the end of a garden hose.

2. The Prior Art

The development of latex based paints has significantly lessened the amount of effort and work that is required to clean rollers and brushes after painting so that they can be reused. Latex based paints, while in a wet state, are readily water soluble and thus, brushes and rollers can simply be cleaned with water. This is a significant improvement over enamel based paints which require that the brushes and rollers be soaked in turpentine to remove the paint and then washed with soap and water to remove the turpentine.

Even though latex based paints can be cleaned with just water, anyone who has ever cleaned a paint roller realizes that significant effort is still required to clean all of the paint from the fiber forming the roller element. Any paint which remains in the fibers lessens the reusable life of the roller.

In the past, rollers have typically been cleaned in a sink or a bucket by simply immersing them in water and vigorously rubbing the fibers by hand to insure that all of the paint is loosened and removed. This method, while being one of the simplest, is also probably the messiest and most time consuming. The person cleaning the roller gets paint on his hands and arms which must in turn be washed off. Also, the bucket or sink becomes coated with paint and thus, must be cleaned and rinsed after the roller is cleaned. Additionally, the roller usually retains a significant amount of paint even after washing the roller in this manner, unless the process is repeated several times.

Another method which has often been used is to simply squirt the roller with a stream of water from a garden hose. When washing a paint roller with a garden hose, it is difficult to control the force of the spray and also the angle at which it impinges the paint roller. Also, there is no way that the roller element can be vigorously rubbed so as to loosen and remove the paint without first setting the hose down. Again, this method, though simple, is both inconvenient and time consuming.

In an attempt to eliminate these problems, several devices have been developed to clean paint rollers. These devices usually comprise cylindrical containers which enclose the roller, together with some type of sprayer for directing a stream of water against the roller. See, for example, U.S. Pat. Nos. 2,831,488, 3,075,534, 3,857,599, 3,731,697 and 3,897,797.

These specially designed devices for cleaning paint rollers may eliminate, to some extent, the problems associated with the first two methods of cleaning paint rollers as mentioned above. By directing a high pressure stream of water against the roller, the paint is generally loosened and removed more easily. However, these devices also appear to be somewhat complicated and, in most instances, may well be more expensive than the paint roller itself. Thus, it is probably not practical for a homeowner doing occasional painting to invest in these devices. It would be easier for him simply to discard the roller and purchase a new one.

Accordingly, what is needed in the art is a device which is inexpensive to manufacture, simple to use, and which can be used to effectively clean paint rollers such that they may be reused.

OBJECTS AND BRIEF SUMMARY OF THE INVENTION

It is a primary object of the present invention to provide a paint roller cleaner which is relatively simple in its construction and is inexpensive to manufacture.

It is a further object to this invention to provide a paint roller cleaner which is simple to use but capable of effectively cleaning a paint roller.

Another object of the present invention is to provide a paint roller cleaner which is small and can be easily stored and which can be easily attached to the end of a garden hose.

These and other objects and features of the present invention will become more fully apparent from the following description and appended claims taken in conjunction with the accompanying drawings.

In accordance with the foregoing objects, the present invention provides a novel paint roller cleaner for cleaning latex based paints from paint rollers. In a first preferred embodiment, the paint roller cleaner of the present invention comprises a generally Y-shaped nozzle designed to be attached to the end of a garden hose. One branch of the nozzle has an enlarged, arcuate opening shaped to fit around a portion of the circumference of the paint roller. Water exits this portion of the nozzle under low pressure and is designed to initially be injected into and soak the paint roller to loosen and remove the bulk of the paint. Additionally, as the roller element is being soaked, the arcuate opening can be used to scrape the roller. The second branch of the nozzle is designed to impart a small, high pressure stream of water to loosen deeply embedded paint and to cause the roller to spin, thus removing the remaining paint and water. Each of the branches of the cleaner is provided with a ball-valve for controlling the flow of water through the respective branch. Thus, the flow of water can be completely turned off at the cleaner or it can be allowed to exit through either one or both of the nozzles.

In a second preferred embodiment, the high pressure nozzle is located directly above the arcuate nozzle. Thus, the arcuate opening can serve as a guide in directing the high pressure stream of water onto the roller. In this embodiment, a single, three-way valve is located in the device. Thus, water can either exit through the high pressure nozzle, through the arcuate nozzle or it can be completely shut off.

BRIEF DESCRIPTION OF THE DRAWINGS

Reference is next made to the drawings in which like parts are designated with like numerals throughout, and in which.

DETAILED DESCRIPTION OF THE PREFERRED EMBODIMENTS

Figure 1:
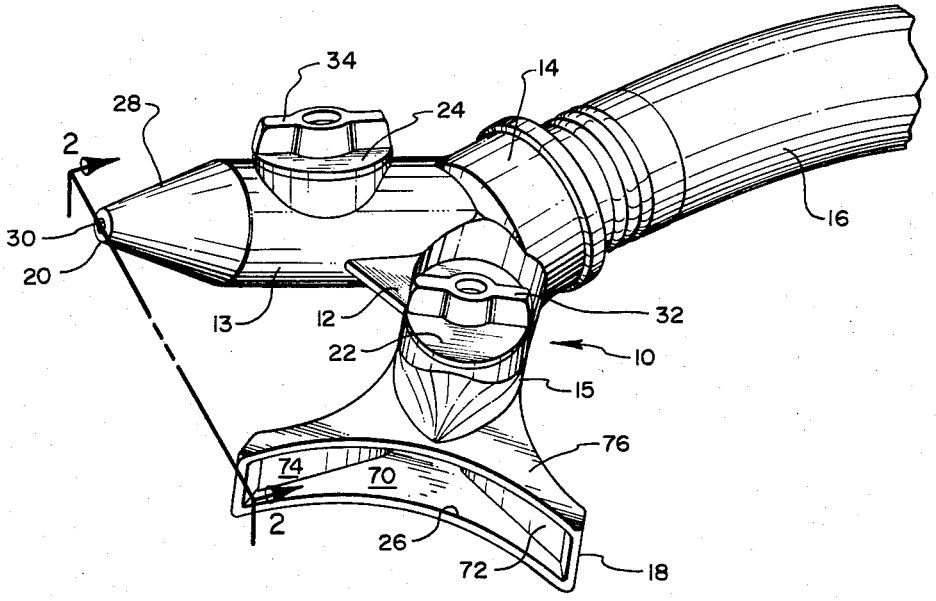
FIG. 1 is a perspective view of a first preferred embodiment of the paint roller cleaner of the present invention which is formed in a Y-shaped configuration.

Referring first to FIG. 1, a first preferred embodiment of the paint roller cleaner of the present invention is generally designated 10. Cleaner 10 includes a generally Y-shaped body 12 having a threaded female base 14 designed to be attached to the end of a common garden hose 16. Attached to the ends of the two branches 13 and 15 of body 12 are soaking nozzle 18 and pressure nozzle 20. These nozzles are specially designed to easily and thoroughly clean a paint roller, as hereinafter more fully described.

In cleaning paint from a paint roller, it is first necessary to completely soak the roller and to remove the bulk of the paint. With the present invention, this is accomplished by utilizing soaking nozzle 18. Nozzle 18 has an arcuate opening 26 formed in the end thereof. Opening 26 is designed such that its radius of curvature will easily fit the radius of curvature of a paint roller. Thus, the paint roller can be positioned longitudinally within arcuate opening 26 (see FIG. 5) for the initial stage of cleaning. Water exits through nozzle 18 under a low pressure and is designed to gently soak the paint roller and to carry away the bulk of the paint. Additionally, as the roller element is being soaked, arcuate opening 26 can be used to gently scrape the roller element to loosen the bulk of the paint so that it can be washed away.

Figure 6:
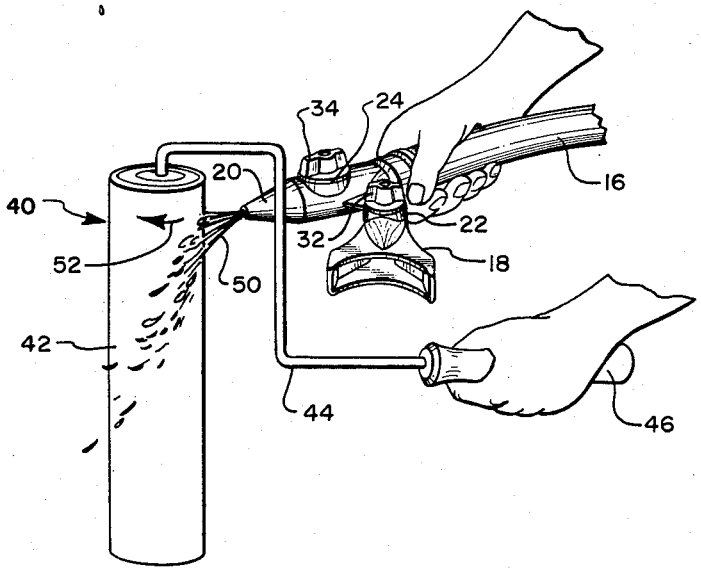
FIG. 6 is a perspective view of a paint roller being cleaned using the first preferred embodiment of the present invention, and illustrating the use of the high pressure nozzle.

With reference again to FIG. 1, pressure nozzle 20 comprises a conical tip 28 having a small opening 30 formed in the forward end thereof. Tip 28 is positioned on the forward end of branch 13 of body 12. Pressure nozzle 20 is designed to provide a high pressure stream of water exiting through opening 30 to thoroughly wash paint from the paint roller, as illustrated in FIG. 6 and as more fully described below.

This high pressure stream of water serves two purposes in cleaning the roller. First, the high pressure forces the water to penetrate the fibers of the roller element, helping to loosen the paint which is embedded therein. Once loosened, this paint can easily be rinsed from the roller. Second, the force of the water causes the roller element to rapidly spin. The centrifugal force caused by this spinning also helps to remove the paint and also the water from the surface of the roller element. Thus, after utilizing nozzle 20 on a paint roller, the roller element is only damp, having had most of the water spun off.

With continued reference to FIG. 1, control valve 22 is positioned behind soaking nozzle 18 for controlling the flow of fluid therethrough, and a corresponding control valve 24 is positioned behind pressure nozzle 20. By positioning both valves 22 and 24 in the closed position, it is possible to shut off the flow of water at cleaner 10. Valves 22 and 24 can also be adjusted by means of the knobs 32 and 34 such that water exits either from soaking nozzle 18 or pressure nozzle 20, or from both nozzles simultaneously. In FIG. 1 the position of knob 32 represents the closed position for valve 22. The position of knob 34 indicates that valve 24 is in the open position.

Figure 2:
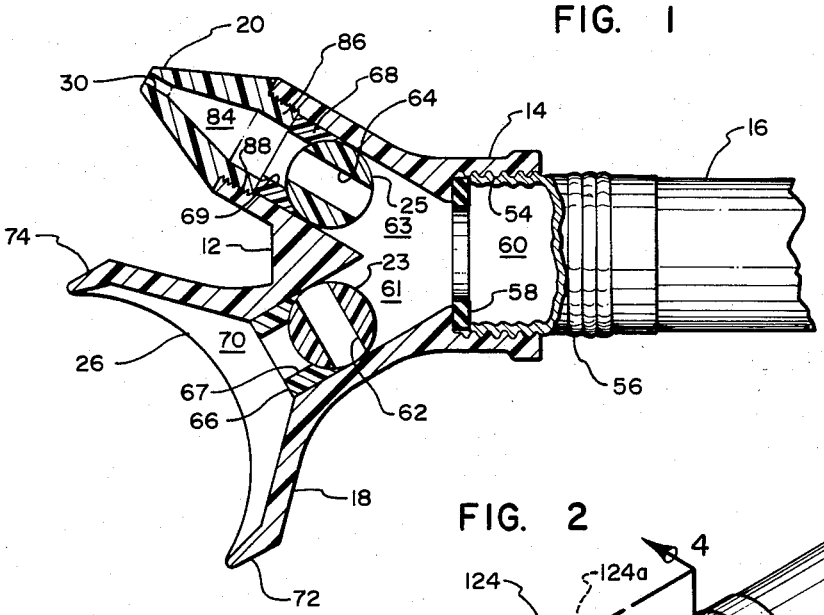
FIG. 2 is a cross-sectional view of the first preferred embodiment taken along line 2—2 of FIG. 1.

Reference is next made to FIG. 2 wherein the first preferred embodiment of the present invention is shown in cross-section to further illustrate the details of its construction. The interior of base 14 of body 12 is threaded at 54 to receive the threaded male connector 56 of hose 16 in mating relationship. A washer 58 is positioned within base 14 forward of male connector 56 to provide a fluid tight seal and to insure against leakage around base 14.

An interior passageway 60 is formed within body 12 and is coaxially aligned with hose 16. Forward of base 14, passageway 60 is bifurcated with a first branch 61 leading to soaking nozzle 18 and a second branch 63 leading to pressure nozzle 20.

A control element in the form of a ball valve 23 is positioned within first branch 61 which leads to nozzle 18. In FIG. 2, ball valve 23 is illustrated in the closed position. Ball valve 23 has a bore 62 passing through the center thereof which, in the closed position, is perpendicularly aligned with the longitudinal axis of branch 61. A cylindrical plug 66 is positioned forward of ball valve 23 in branch 61 to seal the sides thereof and to prevent water from leaking around the edges of valve 23. Plug 66 has a bore 67 passing axially therethrough. By rotating ball valve 23 ninety degrees, bore 62 is placed in axial alignment with branch 61 of channel 60 and bore 67 of plug 66 so that water is allowed to pass therethrough to soaking nozzle 18.

Soaking nozzle 18 is defined by bottom 70, sides 72 and 74, and top 76 (see FIG. 1). The arcuate opening 26 thus formed by nozzle 18 evenly distributes the water exiting therefrom. When a paint roller is placed within arcuate opening 26, water is distributed by the arcuate opening 26 and soaks substantial portions of the roller element to loosen and wash away the wet paint.

With continued reference to FIG. 2, the interior configuration of pressure nozzle 20 is also illustrated in greater detail. Ball valve 25 is positioned within branch 63 of channel 60 behind nozzle 20. Ball valve 25 has a bore 64 passing therethrough which, in FIG. 2, is illustrated in axial alignment with branch 63 of passageway 60 and the bore 69 of cylindrical plug 68. Thus, valve 25 is in the open position. Cylindrical plug 68 is positioned forward of ball valve 25 to prevent leakage around the edges thereof.

Pressure nozzle 20 is generally conical in shape, being tapered towards its tip. The interior channel 84 of nozzle 20 is similarly tapered to direct the stream of water into a high pressure jet. A threaded male fitting 86 is formed on the rear portion of nozzle 20 to mate with corresponding female threads formed in the forward portion 88 of branch 13 of body 12. Thus, nozzle 20 is removably attached to body 12. Should nozzle 20 become plugged by debris passing through the cleaner, nozzle 20 can be removed from body 12 for cleaning.

Figure 3:
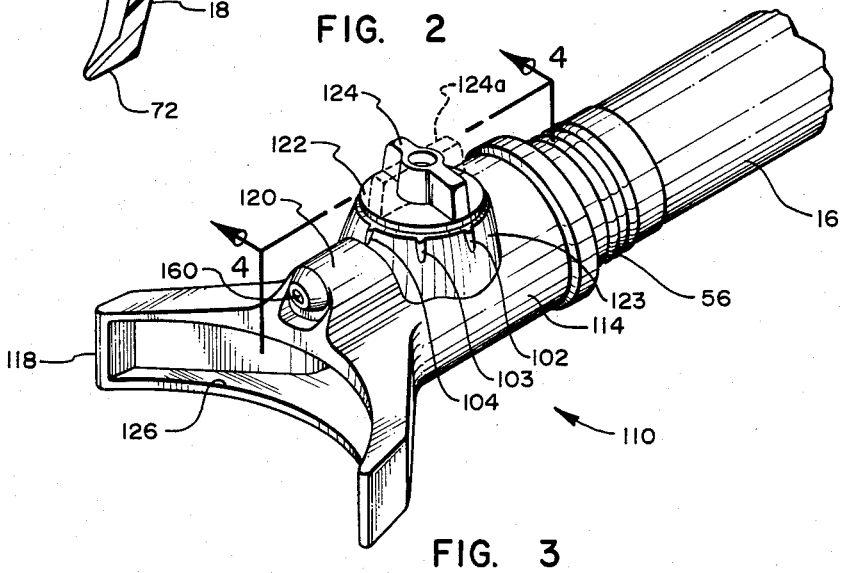
FIG. 3 is a perspective view of a second preferred embodiment of the paint roller cleaner of the present invention wherein the high pressure nozzle is positioned directly above the arcuate nozzle.

Reference is next made to FIG. 3 wherein a second preferred embodiment of a paint roller cleaner according to the present invention is generally illustrated at 110. In this embodiment, pressure nozzle 120 is positioned directly above soaking nozzle 118. Soaking nozzle 118 has an arcuate opening 126 which is essentially identical to arcuate opening 26 of the first preferred embodiment illustrated in FIGS. 1 and 2. Cleaner 110 has a base 114 which is designed to be threadingly attached to the male connector 56 of hose 16.

A three-way valve 122 is positioned in body 112 to control the flow of water to nozzles 118 and 120. Shoulder 123 onto which the control knob 124 of valve 122 is mounted is marked with three ridges 102, 103 and 104 which correspond to the three positions of valve 122. Knob 124 on top of valve 122 is used to rotate the valve between the various positions and to indicate the position of the valve.

As illustrated by the solid lines in FIG. 3, knob 124 is aligned with ridge 102. This corresponds to the open position for soaking nozzle 118. If knob 124 is rotated 90° as illustrated by the dotted line position 124*a*, it will be in alignment with ridge 104 which corresponds to the open position for pressure nozzle 120. If knob 124 is rotated half-way between the two open positions such that it is aligned with ridge 103, the valve is completely closed and water cannot exit from either nozzle.

Figure 4:
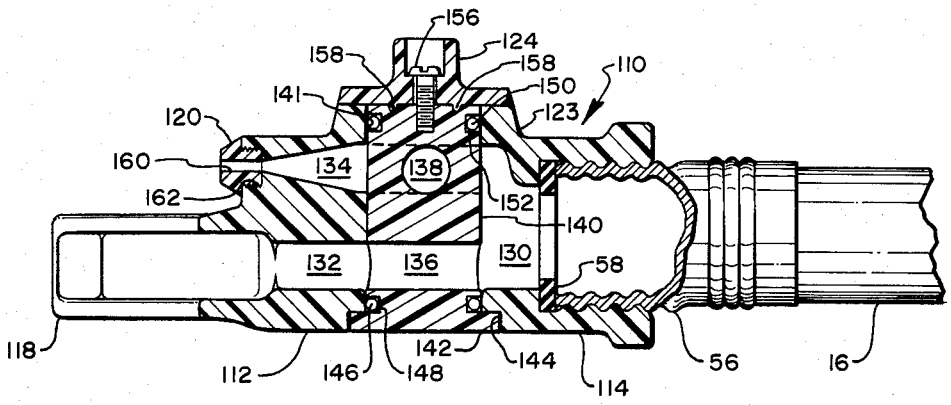
FIG. 4 is a cross-sectional view of the second preferred embodiment taken along line 4—4 of FIG. 3.

Referring now to FIG. 4, the interior construction of the second preferred embodiment of the present invention is best illustrated by the cross-sectional view taken along line 4—4 of FIG. 3.

Cleaner 110 is fastened to hose 16 in the same manner as the first preferred embodiment. Connector 56 on the end of hose 16 is threaded into base 114 of cleaner 110. A washer 58 is positioned forward of connector 56 to prevent water leakage.

Channel 130 formed within body 112 is again bifurcated but in this embodiment the branches are positioned one above the other. Lower branch 132 leads to soaking nozzle 118 and upper branch 134 leads to pressure nozzle 120.

As illustrated in FIG. 4, valve 140 is cylindrical in shape and has bores 136 and 138 passing therethrough. When bore 136 is axially aligned with branch 132 of channel 130 as illustrated in FIG. 4, water exits through nozzle 118. Bore 138 is formed perpendicular to bore 136 such that when bore 136 is in alignment to allow passage of water, bore 138 is misaligned to prevent water from passing through branch 134. When valve 140 is rotated 90°, bore 138 becomes axially aligned with branch 134 such that water can pass therethrough and bore 136 occludes branch 132. When rotated 45° neither bore 138 nor bore 136 are aligned, thus entirely shutting off the flow of water.

Valve 140 fits within a vertical bore 141 formed within body 112. The bottom portion of valve 140 has a flange 142 extending around the periphery thereof which fits into recessed step 144 to keep valve 140 from being forced up through body 112. An O-ring 146 is positioned within groove 148 formed above flange 142 to provide a fluid tight seal and prevent leakage from the bottom of valve 122. Another O-ring 150 is positioned within groove 152 in the upper portion of valve 140 to provide a fluid tight seal at the top of the valve.

Knob 124 is seated on top of shoulder 123 of body 112 and is secured by a screw 156. Two small projections 158 are formed in the lower surface of knob 124. These projections correspond to indentations formed in the top of valve 140 to insure that the valve rotates when knob 124 is rotated.

Soaking nozzle 118 of cleaner 110 is best illustrated in FIG. 3 and is essentially identical to the soaking nozzle 18 of the first preferred embodiment. It has an arcuate opening 126 formed therein to evenly distribute the water to a substantial area of a roller element when it is placed within the arcuate opening 126.

Referring again to FIG. 4, the construction of pressure nozzle 120 is illustrated. In this embodiment, branch 134 of channel 130 is conically tapered from valve 140 to nozzle 120. Nozzle 120 has a cylindrical bore 160 formed through the center thereof which is placed in axial alignment with branch 134. Thus, water passing through bore 138 of valve 140 passes through branch 134 and exits through bore 160 as a high pressure jet. Pressure nozzle 120 has a threaded coupler 162 formed on the base thereof to provide a means for removable attachment to body 112. Thus, pressure nozzle 120 can be removed from cleaner 110 should it become plugged with debris.

By positioning nozzle 120 directly above soaking nozzle 118, arcuate opening 126 can also be used as a guide to align the roller element when utilizing pressure nozzle 120.

Figure 5:
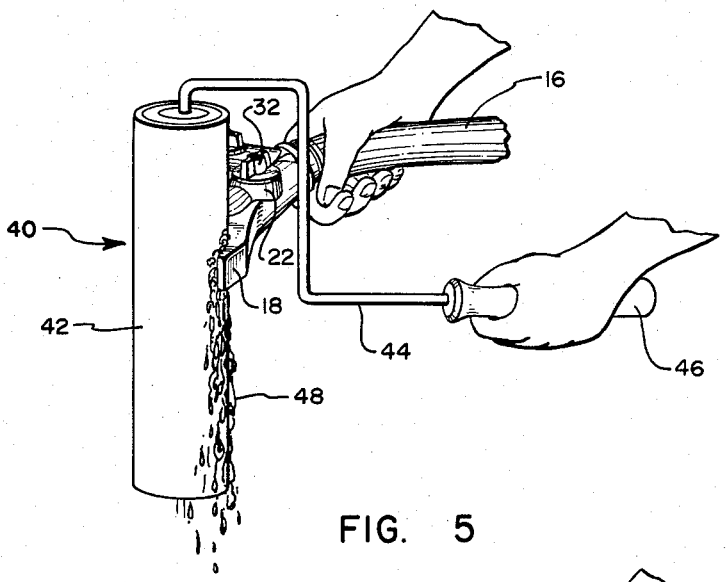
FIG. 5 is a perspective view of a paint roller being cleaned using the first preferred embodiment of the present invention, and illustrating the use of the arcuate nozzle.

Referring now to FIG. 5, the method of utilizing the first preferred embodiment of the paint roller cleaner of the present invention is illustrated. Cleaner 10 is attached to a garden hose 16 which is connected at its other end to a water faucett. Valve 22 which controls soaking nozzle 18 is initially turned to the open position, and valve 24 which controls pressure nozzle 20 is turned to the closed position. Then, while holding roller 40 in one hand and cleaner 10 in the other hand, arcuate opening 26 of soaking nozzle 18 is placed at the top of roller element 42 and is slowly directed up and down the length thereof. This process is repeated around the entire circumference of roller element 42. Thus, water 48 soaks roller element 42 and removes much of the paint.

While soaking roller element 42, cleaner 10 is elevated slightly at the rear to insure that there is a gap between the roller element and the bottom of arcuate opening 26 through which water 48 can exit. Additionally, by tilting cleaner 10, top 76 (see FIG. 1) of nozzle 18 can act as a scraper which aids in removing paint from roller 42.

After roller element 42 is completely soaked and the bulk of the paint has been removed, valve 22 is turned to the closed position and valve 24 is turned to the open position to produce a pressurized jet of water 50 (see FIG. 6). Cleaner 10 is then held a short distance from roller element 42 and water 50 is directed tangentially against the roller 42. The water jet 50 penetrates the fibers of roller 42 to loosen embedded paint and flush it away. Additionally, the jet 50 imparts a spinning motion as illustrated by arrow 52, which causes the paint and water to be spun from roller 42.

The high pressure jet of water 50 can also be used to rinse off any paint which may be on bracket 44 or handle 46 of roller 40. The method of utilizing the second embodiment is essentially identical to that described for the first embodiment.

It will be readily appreciated by those skilled in the art that the paint roller cleaner of the present invention provides a means for easily and efficiently cleaning a paint roller. This device is inexpensive to manufacture since it can be made from plastic material, and is relatively small and easy to store.

Although the present invention has been described with reference to the two embodiments illustrated herein, the invention may be embodied in other specific forms without departing from the spirit or essential characteristics thereof. The described embodiments are to be considered in all respects only as illustrative and not restrictive, and the scope of the invention is, therefore, indicated by the appended claims rather than by the foregoing description. All modifications or changes which come within the meaning and range of equivalency of the claims are to be embraced within their scope.

What is claimed and desired to be secured by United States Letters Patent is:

1. An apparatus attachable to an end of a hose for cleaning a paint roller and the like, said apparatus comprising:

a body, said body having an inlet formed in one end thereof and having means for connecting said inlet to said hose;

a first outlet formed in said body in fluid communication with said inlet, said first outlet comprising means for circumferentially engaging a portion of said paint roller and means for soaking and scraping said portion of the paint roller;

a second outlet formed in said body in fluid communication with said inlet, said second outlet comprising a nozzle for delivering a high pressure jet of water; and means for controlling the flow of water from said hose through said first and second outlets.

2. An apparatus as defined in claim 1 wherein said first and second outlets formed in said body are formed side-by-side.

3. An apparatus as defined in claim 2 wherein said means for controlling the flow of water from said hose through said first and second outlets comprises:

a first control valve positioned within said body between said first outlet and said inlet; and a second control valve positioned within said body between said second outlet and said inlet.

4. An apparatus as defined in claim 1 wherein said first and second outlets formed in said body are positioned one on top of the other.

5. An apparatus as defined in claim 4 wherein said means for controlling the flow of water from said hose through said first and second outlets comprises a single control valve positioned within said body between said first and second outlets and said inlet, said control valve comprising means for alternately directing the flow of fluid to one of said first and second outlets.

6. An apparatus as defined in claim 1 wherein said second outlet comprises means for detaching said nozzle from said body to permit cleaning and removal of debris or the like.

7. An apparatus as defined in claim 1 wherein said body is constructed of plastic.

8. An apparatus for cleaning a paint roller and the like, the apparatus being designed for attachment to an end of a hose, and said apparatus comprising:

a body having an inlet formed in one end thereof and having means for connecting said inlet to the end of said hose;

a first outlet formed in said body in fluid communication with said inlet, said first outlet comprising means for circumferentially engaging a portion of said paint roller and means for soaking and scraping said portion of the paint roller;

a second outlet formed in said body in fluid communication with said inlet, said second outlet comprising a nozzle for delivering a high pressure jet of water;

means for detaching said nozzle from said body to permit cleaning or removal of debris from said nozzle; and means for controlling the flow of water from said hose through said first and second outlets.

9. An apparatus as defined in claim 8 wherein said body is constructed of plastic and wherein said body comprises two branches, one said branch having a passageway formed therethrough which connects said first outlet to said inlet, and the other branch having a passageway formed therethrough which connects said second outlet to said inlet.

10. An apparatus as defined in claim 9 wherein said branches of said body are formed side-by-side so as to form a generally Y-shaped body.

11. An apparatus as defined in claim 10 wherein means for controlling the flow of water through said first and second outlets comprises:

a first control valve positioned in one of the passageways formed in one of the branches of said body; and a second control valve positioned in the other said passageway of the other said branch of said body.

12. An apparatus as defined in claim 9 wherein said branches of said body are formed one on top of the other.

13. An apparatus as defined in claim 12 wherein said means for controlling the flow of water through said first and second outlets comprises:

a control valve positioned between said inlet and said first and second outlets such that in one position said control valve directs water through said first outlet and in a second position said control valve directs water through said second outlet; and means for indicating the position of said control valve.

14. An apparatus as defined in claim 13 wherein said control valve comprises an elongated, cylindrical member positioned between said inlet and said first and second outlets, said cylindrical member having a first bore passing therethrough for connecting said first outlet to said inlet, and having a second bore rotated approximately 90° from said first bore, said second bore connecting said second outlet to said inlet when said cylindrical member is rotated 90° to align said second bore with said second outlet.

* * * * *